US011952790B2

(12) United States Patent
Phillips

(10) Patent No.: US 11,952,790 B2
(45) Date of Patent: Apr. 9, 2024

(54) BOOTH WITH VENTILATION SYSTEM

(71) Applicant: TRIESTE GROUP ONE LTD, Hertfordshire (GB)

(72) Inventor: Roger Phillips, Hertfordshire (GB)

(73) Assignee: TRIESTE GROUP ONE LTD, Hertfordshire (GB)

( * ) Notice: Subject to any disclaimer, the term of this patent is extended or adjusted under 35 U.S.C. 154(b) by 732 days.

(21) Appl. No.: 17/072,271

(22) Filed: Oct. 16, 2020

(65) Prior Publication Data

US 2021/0115687 A1 Apr. 22, 2021

(30) Foreign Application Priority Data

Oct. 18, 2019 (GB) ..... 1915147

(51) Int. Cl.

| | |
|---|---|
| ***E04H 1/12*** | (2006.01) |
| ***E04B 1/343*** | (2006.01) |
| ***E04B 1/82*** | (2006.01) |
| ***F24F 13/24*** | (2006.01) |

(52) U.S. Cl.

CPC ..... *E04H 1/125* (2013.01); *E04B 1/34321* (2013.01); *E04B 1/8218* (2013.01); *F24F 13/24* (2013.01); *F24F 2013/242* (2013.01)

(58) Field of Classification Search

CPC ..... F24F 7/06; F24F 7/08; F24F 7/013; F24F 7/10; F24F 13/0227; F24F 2007/001; F24F 2007/0025; E04H 1/12–125

See application file for complete search history.

(56) References Cited

U.S. PATENT DOCUMENTS

| | | | | |
|---|---|---|---|---|
| 5,123,874 | A | 6/1992 | White, III | |
| 2017/0295673 | A1* | 10/2017 | Anderl | H05K 7/20181 |
| 2019/0177993 | A1 | 6/2019 | Shell et al. | |

FOREIGN PATENT DOCUMENTS

| | | | |
|---|---|---|---|
| JP | 2000120287 | A * | 4/2000 |
| JP | 2006349246 | A * | 12/2006 |
| KR | 10-2015-013483 | A | 9/2015 |
| KR | 10-1554108 | B1 | 9/2015 |

(Continued)

OTHER PUBLICATIONS

Extended European Search Report dated Mar. 9, 2021, issued in EP Patent Application No. 20202406.3.

(Continued)

*Primary Examiner* — Edelmira Bosques
*Assistant Examiner* — Michael James Giordano
(74) *Attorney, Agent, or Firm* — Lewis Roca Rothgerber Christie LLP

(57) ABSTRACT

A booth comprising a plurality of walls, a roof, and a ventilation system, the walls and the roof enclosing a space to be ventilated by the ventilation system, and the ventilation system comprising: at least one fan for providing an airflow, an air inlet through which air enters the space to be ventilated from outside the booth, and an air outlet through which air exits the space to be ventilated to outside the booth, wherein the air outlet comprises a first air outlet aperture and a second air outlet aperture and an air outlet channel extending between the first and second air outlet apertures, wherein the air outlet channel is provided at least partly inside one of the walls.

15 Claims, 3 Drawing Sheets

(56) References Cited

FOREIGN PATENT DOCUMENTS

| | | | | |
|---|---|---|---|---|
| KR | 20180011996 | A | * | 2/2018 |
| WO | WO 2018/011462 | A1 | | 1/2018 |

OTHER PUBLICATIONS

UK Intellectual Property Office Combined Search and Examination Report dated Mar. 16, 2021, issued in GB Patent Application No. GB2016452.1.

Combined Search and Examination Report dated Apr. 3, 2020, issued in GB Patent Application No. 1915147.1, 3 pages.

* cited by examiner

BOOTH WITH VENTILATION SYSTEM

CROSS-REFERENCE TO RELATED APPLICATION(S)

This application claims priority to and the benefit of British Patent Application No. 1915147.1, filed Oct. 18, 2019, the entire content of which is incorporated herein by reference.

SUMMARY

The present invention relates to a booth, in particular to such a booth comprising an improved air circulation/ventilation system.

Open plan working environments, such as office spaces, provide many advantages including the efficient use of available space and the promotion of interaction between workers using the space. However, such open plan environments suffer drawbacks where, for example, workers require a quiet space in which to concentrate on work, conduct meetings or make telephone calls.

To address this issue, some open plan office spaces are provided with a limited number of isolated offices or meetings rooms, which can be used by workers when a quieter or more private environment is required. Such isolated spaces are typically built into the permanent structure of the office space, and are commonly located at or towards the periphery of the office space for convenience.

A disadvantage of this arrangement is that such isolated spaces are generally inflexible and immobile and thus cannot be easily adapted in response to the changing requirements of the users of the office space. For example, an organisation owning or renting an office space may experience fluctuations in the number of workers using the office space, and thus the number of isolated spaces required may vary over time. Similarly, the occupants of a rented office space may change on a regular or semi-regular basis, with different occupants having different requirements in terms of the number or nature of isolated spaces within the office space.

To address these issues the use of freestanding soundproofed booths which can be readily re-located, and which provide a convenient isolated space for a worker or workers in an open plan office environment, are becoming more popular.

Soundproof booths are typically sealed structures requiring air circulation/ventilation to prevent the internal temperature from getting too high. For such purposes air circulation/ventilation systems are required. With relocatable booths, where it is not typically possible to connect the booths to ventilation systems of the surrounding space, the air circulation/ventilation system must be incorporated into the booth.

The present invention arose in a bid to provide an improved air circulation/ventilation system for a booth.

According to the present invention in a first aspect there is provided a booth comprising a plurality of walls, a roof, and a ventilation system, the walls and the roof enclosing a space to be ventilated by the ventilation system, and the ventilation system comprising: at least one fan for providing an airflow, an air inlet through which air enters the space to be ventilated from outside the booth, and an air outlet through which air exits the space to be ventilated to outside the booth, wherein the air outlet comprises a first air outlet aperture, a second air outlet aperture and an air outlet channel extending between the first and second air outlet apertures, wherein the air outlet channel is provided inside one of the walls of the booth.

There is preferably an indirect air path from the first air outlet aperture to the second air outlet aperture. An indirect air path means that the air path has curves or bends between the first air outlet aperture and the second air outlet aperture. An indirect air path may improve sound attenuation relative to a direct air path.

The first air outlet aperture and the second air outlet aperture are preferably vertically spaced from one another. Preferably the first air outlet aperture and the second air outlet aperture are vertically spaced from one another by substantially the height of the wall inside of which the air outlet channel is provided: this provides the advantage that sound in the air is attenuated by passing the air through a long air outlet channel, which preferably provides an indirect air path.

The air outlet channel extending between the first air outlet aperture and the second air outlet aperture is not provided or formed in a single layer or plane of the booth, so it is not formed only in the roof or only in the wall, for example.

It is most preferable that the air inlet and the second air outlet apertures are provided in the roof of the booth. With air entering and exiting the space to be ventilated (i.e. the internal space of the booth to be occupied by a user) through the roof, booths may be butted up against one another or against a wall without risk of disrupting ventilation. The first air outlet aperture may be located at/adjacent to a basal edge of one of the walls.

In a preferred embodiment, the air outlet channel extending between the first and second air outlet apertures extends along the complete height of an internal or external surface of the wall in which the air outlet channel is provided. In this respect, the wall may comprise two panels and the air outlet channel may be defined in part by the space between the two panels.

The air outlet channel provided inside the wall may be lined with sound absorbing material. Preferably the air outlet channel provided inside the wall itself provides a direct air path (ie with no curves or bends). It is preferred that no baffles or other sound attenuating structures or devices are mounted within the air outlet channel provided inside the wall itself. This provides a simplicity to the structure of the booth and an ease to its assembly and disassembly.

The first air outlet aperture may be located adjacent a base of the wall having the air outlet channel provided inside. In this respect, the first air outlet aperture may be provided in a base that supports the booth and extends along a basal edge of the wall, or adjacent said base.

In a preferred embodiment, the booth is not provided with its own floor section (ie for a user of the booth to stand on): instead the existing floor is used with the base providing support for the walls of the booth. The base may or may not be fixed to the existing floor.

The base may comprise elongate sections, arranged to form the periphery of the base. The elongate sections may be substantially U-shaped in cross-section. The present invention does not provide a floor section (ie for a user of the booth to stand on) that has an internal ventilation system. Hence cooling provided by the ventilation system of the present invention is not degraded by the close presence of a floor.

The second air outlet aperture may be located in the roof. The air outlet channel may therefore be provided partly in the roof, the air outlet channel being continuous between sections of the air outlet channel in the roof and in the wall.

In a preferred embodiment, the wall and/or roof comprises an inner panel and an outer panel and the air outlet channel is defined by a space between the panels.

The air inlet may comprise a first air inlet aperture and a second air inlet aperture and an air inlet channel extending between the first and second air inlet apertures.

The air inlet channel and the air outlet channel are preferably isolated from one another.

The air inlet channel may be provided inside the roof. The air inlet may be provided in the roof. The air inlet may comprise the fan.

The booth may comprise a plurality of the first air inlet apertures, at least two of the first air inlet apertures being spaced from one another and directing airflow in directions away from one another.

The booth may comprise a plurality of the second air outlet apertures, at least two of the second air outlets being spaced from one another and directing airflow in directions away from one another.

The air inlet and the second air outlet aperture may comprise directional vents. The directional vents may be adjustable for altering the direction of airflow. The directional vent of the air inlet and the directional vent of the second air outlet apertures may direct airflow in directions away from one another.

In one embodiment, in use of the booth, air is drawn into the booth through the air inlet by the fan and is drawn out of the booth through the first air outlet aperture, into the air outlet channel and ejected via the second air outlet aperture.

The air inlet, the fan and the second air outlet aperture may be provided in the roof of the booth and the first air outlet aperture may be provided adjacent a base of the wall in which the air outlet channel is provided.

Preferably, the ventilation system of the present invention is not connected to a separate air conditioning system or air supply apparatus.

The soundproofing booth of the present invention may be sized to stand on or be fixed to a relatively small area of floor, for example 1 $m^2$, but may alternatively be sized to stand on or be fixed to a relatively large area of floor, for example 100 $m^2$.

BRIEF DESCRIPTION OF THE DRAWINGS

Non-limiting embodiments of the present invention will now be described, by way of example only, with reference to the accompanying drawings, in which.

DETAILED DESCRIPTION

Figure 1:
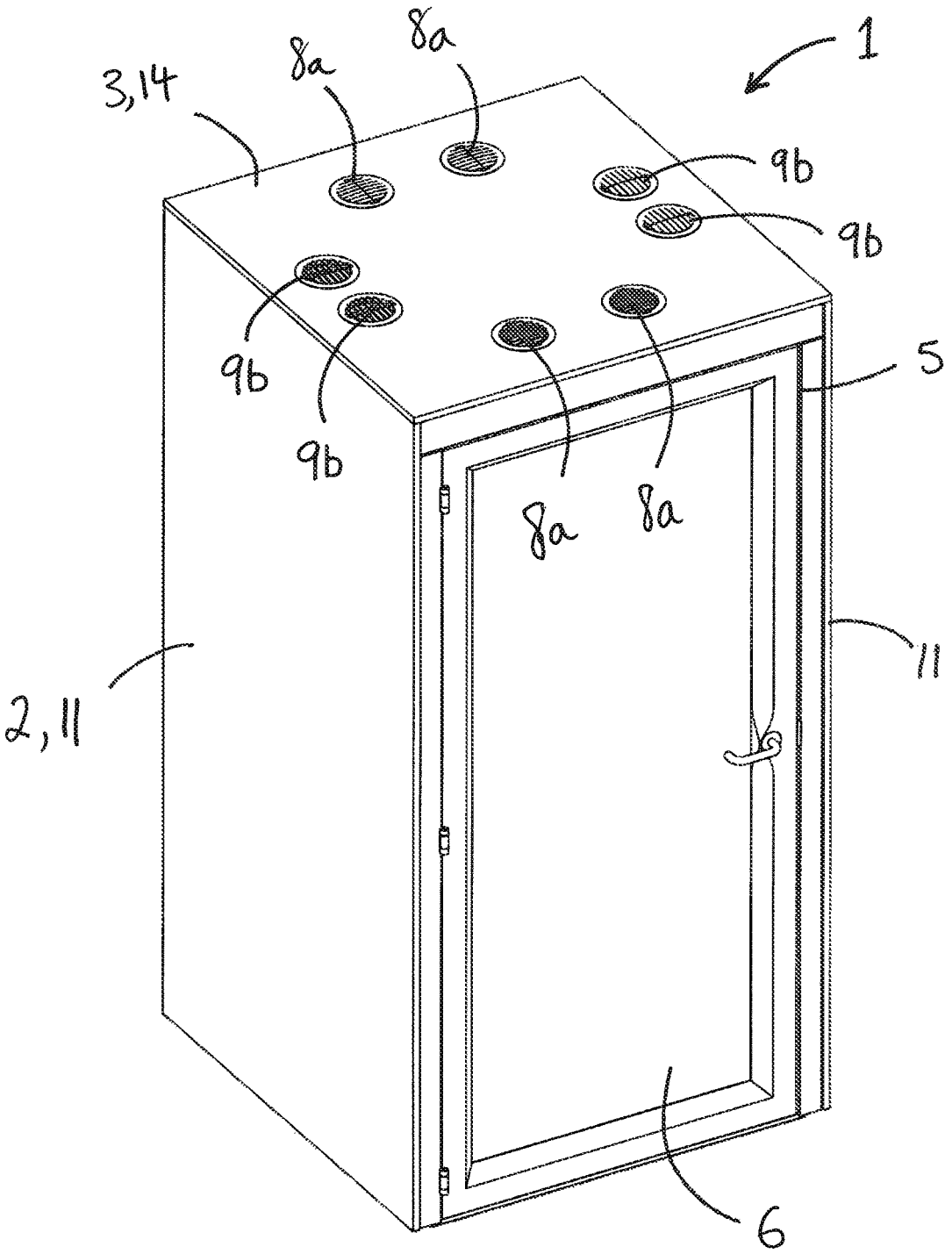
FIG. 1 is a perspective view of a booth according to one embodiment of the present invention.

With reference to the figures, there is shown a booth 1 according to an embodiment of the present invention. The booth is soundproof. The booth is freestanding and comprises upstanding peripheral walls 2 and a roof 3. One of the walls 2 defines an opening 5 that is closed by a door 6. The walls 2 and the roof 3 enclose a space to be ventilated by a ventilation system. The ventilation system comprises a fan 7 for providing an airflow, an air inlet 8 through which air enters the space to be ventilated from outside the booth, and an air outlet 9 through which air exits the space to be ventilated to outside the booth. The air outlet comprises a first air outlet aperture 9*a* and a second air outlet aperture 9*b* and an air outlet channel 9*c* extending between the first and second air outlet apertures 9*a*, 9*b*, wherein the air outlet channel 9*c* is provided at least partly inside one of the walls of the booth.

Figure 3:
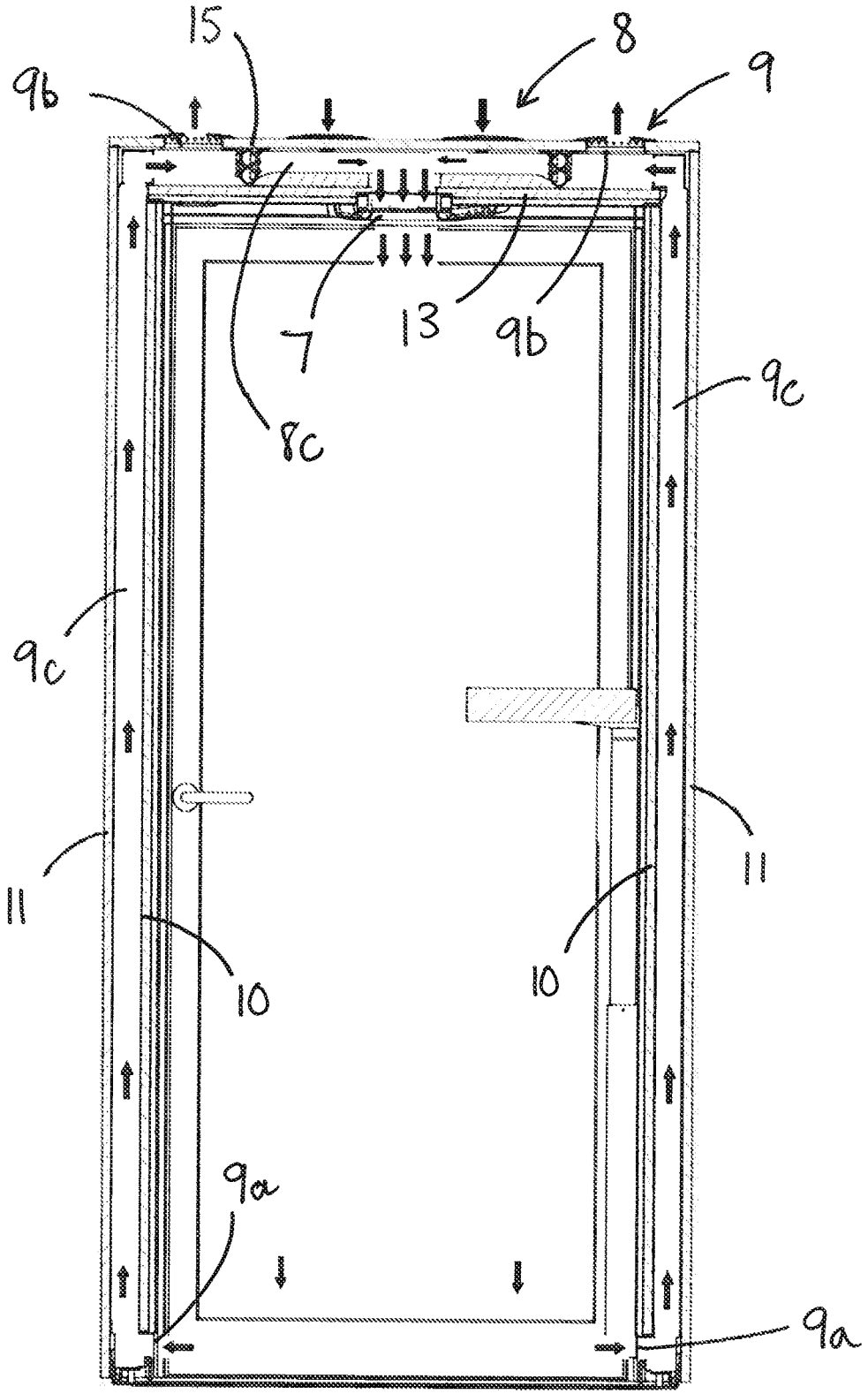
FIG. 3 is sectional view of the booth of FIG. 1.

There is preferably an indirect air path from the first air outlet aperture 9*a* to the second air outlet aperture 9*b*, as best shown in FIG. 3. The first air outlet aperture 9*a* and the second air outlet aperture 9*b* are preferably vertically spaced from one another. As discussed in greater detail below, in the present arrangement, the second air outlet aperture 9*b* is located in the roof 3 whilst the first air outlet aperture 9*a* is located adjacent a base of one of the walls 2. In an alternative arrangement, the first and second air outlet apertures may be provided on different walls 2 of the booth, wherein they could be at the same vertical height in this case.

In the present arrangement two of the walls 2 are provided with air outlet channels 9*c*, as best seen in FIG. 3. It is to be noted that a single wall only may be provided with an air outlet channel or any number of additional walls may also be provided with air outlet channels. The present invention is not to be limited in this regard and may be dependent on the shape of the booth and/or the specific number of walls the booth has.

Whilst in the present arrangement the booth has four walls 2 (and thereby four sides) it could have more or less walls/sides in alternative arrangements. In alternative arrangements the booth could take numerous forms, including triangular, hexagonal or octagonal-shaped or otherwise, wherein adjacent sides would be at an oblique angle to one another rather than perpendicular to one another as in the present arrangement. More than this, the booth could be constructed with curved walls.

Figure 2:
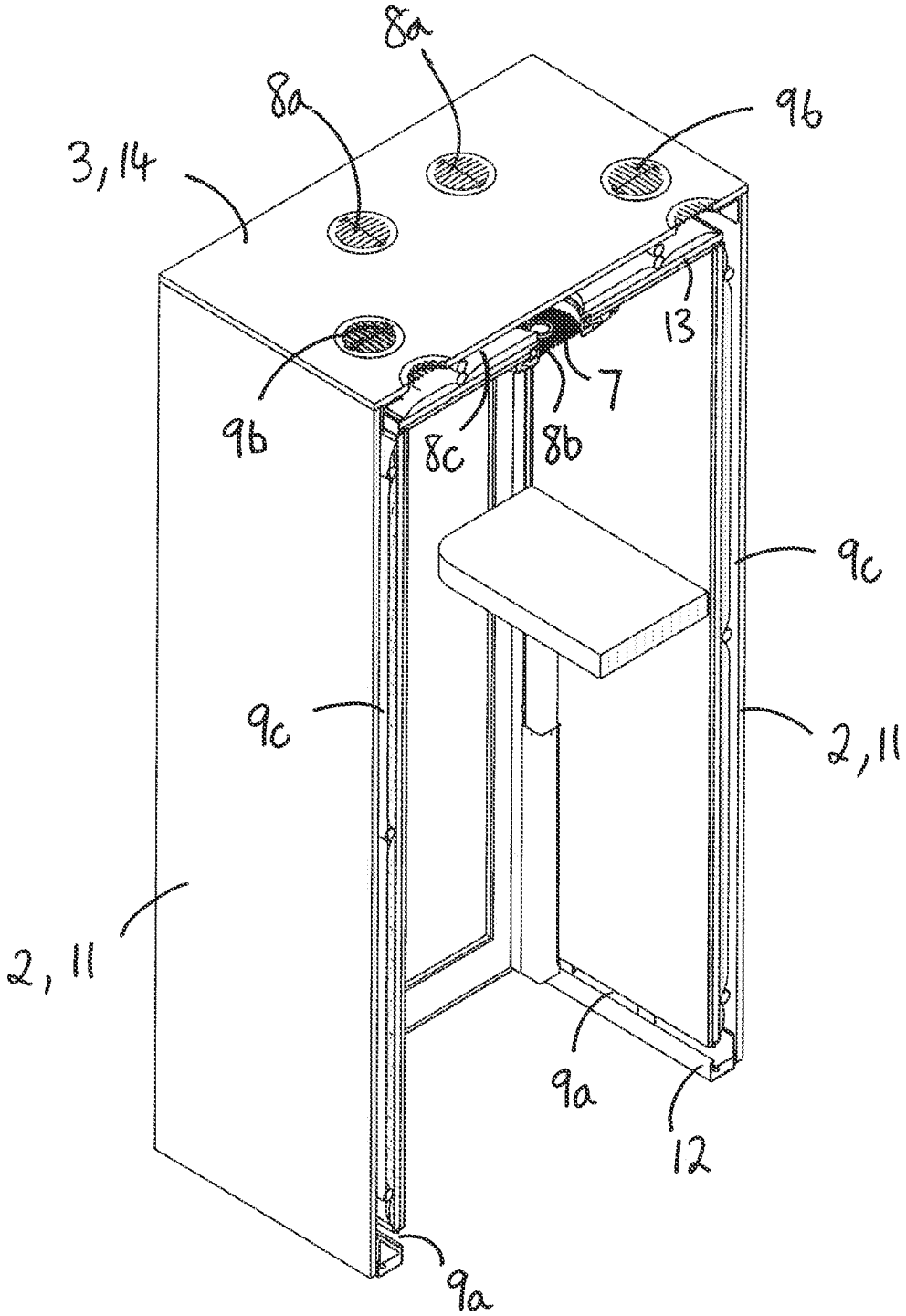
FIG. 2 is a perspective cut-away view of the booth of FIG. 1.

The form of the one or more air outlet channels may depend on the structure of the booth. In the present arrangement, the walls comprise inner and outer panels 10, 11 fixed to vertical support members (not shown), which vertical support members preferably form part of a sub frame. The vertical support members may be attached to a base 12. The air channels 9*b* are defined at least in part by spaces between the panels, as seen in FIGS. 2 and 3. In alternative arrangements, the air channels may be formed by ducting or otherwise. Further, the air channels may be formed into a single layer of a sandwich-type wall structure. In arrangements provided with a base 12, particularly but not exclusively arrangements where the base is provided at the periphery of the booth only, as seen in FIG. 2, the first air outlet aperture may be provided in or adjacent the base in a region of the base that extends along a basal edge of the respective wall comprising the air outlet channel 9*c*.

Any or all of the walls 2 may comprise at least one inner panel and at least one outer panel 10, 11, which oppose one another and comprise respective inner and outer faces of the respective wall 2. With the inner and outer panels 10, 11 mounted to vertical support members, the vertical support members may comprise either a plurality of vertically spaced lugs or a plurality of vertically spaced hooks that are provided between the inner and outer panels 10,11, wherein the inner and outer panels 10, 11 each comprise a corresponding plurality of the other of the vertically spaced hooks or lugs, and the lugs and hooks engage with one another to support the first and second panels on the support element. It should be appreciated that numerous other means of fixing panels to the sub frame will be possible, as will be readily appreciated by those skilled in the art. The present invention is not to be limited in this regard.

Whilst in the present arrangement, the walls comprise the inner and outer panels 10, 11 fixed to vertical support members, which may form part of a sub frame, it should be appreciated that the present invention is applicable to booths that have alternative structures, such as booths formed by attaching complete composite or laminate panels to a base, or otherwise. The present invention is not to be limited to the specific structure of the depicted arrangement.

The panels 10, 11 may take any suitable form. They will preferably have sufficient rigidity to prevent sagging. The inner panels may comprise padded fabric panels to provide for acoustic damping. The inner panels will preferably abut one another, resiliently, to aid in soundproofing. The outer panels may be rigid panels and could be formed from wood, plastic or otherwise. The inner and outer panels could be formed from the same materials or from different materials. There may be sound proofing panels or materials provided between the inner and outer panels. These may be included or omitted in dependence on the acoustic properties of the inner and outer panels.

The walls 2 may comprise multiple smaller inner and outer panels or a single inner panel and a single outer panel per wall. Multiple panels may be arranged to form a substantially flush surface. The use of multiple smaller panels will allow for more compact transportation or storage when the booth is dismantled. In the present arrangement, the walls each comprise a single outer panel.

The roof may have a similar structure to the walls and this may comprise any of the above described possible wall structures. In the depicted arrangement, the roof 3 comprises inner and outer panels 13, 14 like the walls 2. There is a single inner panel and a single outer panel, although this need not be the case. Where the second air outlet aperture 9*b* is provided in the roof, as in the depicted arrangement, the air outlet channel 9*c* may be continuous between the wall and the roof, as shown. With inner and outer panels, the portion of the air outlet channel 9*c* in the roof is provided between the inner and outer panels, as best seen in FIG. 3.

It is preferable, to further enhance sound proofing, that the outer panels 11 of the walls 2 and the outer panel 14 of the roof 3 are sealed to one another to provide a sealed outer layer.

The air inlet 8 is preferably provided in the roof, as shown. The air inlet may comprise a first air inlet aperture 8*a*, a second air inlet aperture 8*b* and an air inlet channel 8*c* extending between the first and second air inlet apertures, wherein the air inlet channel 8*c* is provided inside the roof. There is preferably an indirect air path from the first air inlet aperture 8*a* to the second air inlet aperture 8*b*. In such an arrangement, the first air inlet aperture 8*a* and second air inlet aperture are offset from one another (horizontally). In alternative arrangements, there could be alignment between the first and second air inlet apertures 8*a*, 8*b*. The air inlet 8 is provided with the fan 7. In the present arrangement, the fan is provided behind the second air inlet aperture 8*b*. It could, of course be arranged otherwise.

In the present arrangement, there is only a single fan shown. In alternative arrangements there could be multiple fans provided. There could for example, be inlet and outlet fans provided.

In the present arrangement, comprising an air inlet channel 8*c* and an air outlet channel 9*c*, these channels are isolated from one another so that airflows into and out of the internal space to be ventilated are separated. In the present arrangement, gaskets 15 are provided in the space between the inner and outer panels 13, 14, which provide suitable isolation. In dependence on the form of the inlet and outlet 8, 9 and/or the form of the walls and the roof 2, 3, other means of separating airflows may be provided, as will be readily appreciated by those skilled in the art.

It is preferable, as shown in FIG. 1, that there is a plurality of the first air inlet apertures 8*a*. At least two of the first air inlet apertures 8*a* being spaced from one another and directing airflow in directions away from one another. It is also preferable that there is a plurality of the second air outlet apertures 9*b*, at least two of the second air outlets 9*b* being spaced from one another and directing airflow in directions away from one another. In the present arrangement, the first air inlet apertures 8*a* and the second air outlet apertures 9*b* are arranged along peripheral edges of the roof 3. The first air inlet apertures 8*a* are provided along first and second opposed peripheral edges and the second air outlet apertures are provided along third and fourth opposed peripheral edges. The first air inlet apertures 8*a* and the second air outlet apertures 9*b* are directed outwards, such that the direction of airflow for air drawn into the opposed first air inlet apertures 8*a* is at substantially 180 degrees to one another and the direction of airflow for air exiting the second air outlet apertures is at substantially 180 degrees to one another. For such purposes the first air inlet apertures 8*a* and the second air outlet apertures 9*b* preferably comprise directional vents. They may be adjustable so that airflow direction of any of the apertures may be adapted to the environment in which the booth is placed.

Whilst the apertures are shown to be annular, they may take any alternative form, they could be strip like in shape for example. Moreover, whilst in the present arrangement there are two first inlet air apertures 8*a* and two second outlet air apertures 9*b*, there could be more or less inlet and/or apertures of the same or differing form and offering fixed or variable directionality of airflow. The apertures also need not be provided along the peripheral edges.

FIG. 3 shows the airflow path for the ventilation system. Air is drawn into the booth through the air inlet 8 by the fan 7 and ejected via the air outlet 9. In the present arrangement, (cooling) air is drawn into the booth from the front and rear of the booth 1 through the first inlet air apertures 8*a*, it is pushed out of the second air outlet aperture 8*b* by the fan 7 and then is drawn out of the internal space of the booth through the first air outlet apertures 9*a*, it travels through the air outlet channel 9*c* and is pushed out of the left and right sides of the booth 1 through the second air outlet apertures 9*b*. With such an arrangement, booths 1 may be placed next to one another and/or against a wall without interrupting the flow of air. Moreover, inlet and outlet airflows are separated to avoid drawing warm expelled air into any of the booths.

A benefit of drawing air up through the walls, particularly walls such as the left and right walls of the booth of the present arrangement that are not provided with the door is that the exiting airflow may be passed behind electrical equipment to draw away heat. For example, suitable openings in the inner panel 10 may be provided, with any additional ducting required, to draw the air across the back of a computer monitor, or otherwise. In one arrangement, the additional ducting may be provided in a frame for a monitor, or other electrical device, so that air travelling vertically up through the air outlet channel 9*c* is diverted from the air outlet channel 9*c* into the frame via a first opening in the inner panel 10 and out of the frame and back into the air outlet channel through a second opening in the inner panel 10 that is vertically above the first opening, the frame defining a channel between the first and second openings. The electrical device will be exposed to the channel in the frame, or other suitable structure.

The invention has been described above with reference to specific embodiments, given by way of example only. It will be appreciated that many different arrangements of are possible within the scope of the appended claims.

What is claimed is:

1. A booth comprising a plurality of walls, a roof comprising an upwardly facing outer surface, and a ventilation system, the walls and the roof enclosing a space to be ventilated by the ventilation system, and the ventilation system comprising:

at least one fan for providing an airflow, an air inlet through which air enters the space to be ventilated from outside the booth, wherein the air inlet is located on the upwardly facing outer surface of the roof of the booth and an air outlet through which air exits the space to be ventilated to outside the booth, wherein the air outlet comprises a first air outlet aperture and a second air outlet aperture and an air outlet channel extending between the first and second air outlet apertures, wherein the air outlet channel is provided at least partly inside one of the walls, and wherein the first air outlet aperture is located at or adjacent to a basal edge of one of the walls, and wherein the second air outlet aperture is located on the upwardly facing outer surface of the roof of the booth.

2. A booth as claimed in claim 1, wherein there is an indirect air path from the first air outlet aperture to the second air outlet aperture.

3. A booth as claimed in claim 1, wherein the first air outlet aperture and the second air outlet aperture are vertically spaced from one another.

4. A booth as claimed in claim 1, wherein the first air outlet aperture is provided in a base that supports the booth and extends along a basal edge of the wall.

5. A booth as claimed in claim 1, wherein the air outlet channel is provided partly in the roof, the air outlet channel being continuous between sections of the air outlet channel in the roof and the wall.

6. A booth as claimed in claim 1, wherein the wall and/or roof comprises an inner panel and an outer panel and the air outlet channel is defined by a space between the panels.

7. A booth as claimed in claim 1, wherein the air inlet comprises a first air inlet aperture and a second air inlet aperture and an air inlet channel extending between the first and second air inlet apertures.

8. A booth as claimed in claim 7, wherein the air inlet channel and the air outlet channel are isolated from one another.

9. A booth as claimed in claim 7 comprising a plurality of the first air inlet apertures, at least two of the first air inlet apertures being spaced from one another and directing airflow in directions away from one another.

10. A booth as claimed in claim 7, wherein the air inlet channel is provided inside the roof.

11. A booth as claimed in claim 1 comprising a plurality of the second air outlet apertures, at least two of the second air outlets being spaced from one another and directing airflow in directions away from one another.

12. A booth as claimed in claim 1, wherein the air inlet and the second air outlet aperture comprise directional vents.

13. A booth as claimed in claim 12, wherein the directional vents are adjustable for altering the direction of airflow.

14. A booth as claimed in claim 12, wherein the directional vent of the air inlet and the directional vent of the second air outlet apertures direct airflow in directions away from one another.

15. A booth as claimed in claim 1, wherein the air inlet comprises the fan.

* * * * *